United States Patent [19]

Yamatsuta et al.

[11] Patent Number: 4,547,435

[45] Date of Patent: Oct. 15, 1985

[54] METHOD FOR PREPARING FIBER-REINFORCED METAL COMPOSITE MATERIAL

[75] Inventors: Kohji Yamatsuta, Ibaraki; Ken-ichi Nishio, Shiga, both of Japan

[73] Assignee: Sumitomo Chemical Company, Ltd., Osaka, Japan

[21] Appl. No.: 601,282

[22] Filed: Apr. 17, 1984

Related U.S. Application Data

[62] Division of Ser. No. 285,975, Jul. 23, 1981, Pat. No. 4,489,138.

[30] Foreign Application Priority Data

| | | | |
|---|---|---|---|
| Jul. 30, 1980 | [JP] | Japan | 55-105729 |
| Jul. 31, 1980 | [JP] | Japan | 55-106154 |
| Apr. 7, 1981 | [JP] | Japan | 56-52616 |
| Apr. 7, 1981 | [JP] | Japan | 56-52617 |
| Apr. 7, 1981 | [JP] | Japan | 56-52618 |
| Apr. 7, 1981 | [JP] | Japan | 56-52620 |
| Apr. 7, 1981 | [JP] | Japan | 56-52621 |
| Apr. 7, 1981 | [JP] | Japan | 56-52623 |

[51] Int. Cl.[4] ..... B32F 15/20

[52] U.S. Cl. ..... 428/614; 428/627; 428/654

[58] Field of Search ..... 428/614, 654; 264/63

[56] References Cited

U.S. PATENT DOCUMENTS

| | | | |
|---|---|---|---|
| 3,796,587 | 3/1974 | Sara | 75/0.5 R |
| 4,101,615 | 7/1978 | Horikiri et al. | 264/63 |
| 4,241,148 | 12/1980 | Schoer et al. | 428/654 |
| 4,444,603 | 4/1984 | Yamatsuta et al. | 428/614 |

FOREIGN PATENT DOCUMENTS

| | | |
|---|---|---|
| 49-53118 | 5/1974 | Japan . |
| 13768 | 5/1976 | Japan . |
| 70116 | 6/1976 | Japan . |
| 30407 | 3/1978 | Japan . |
| 1390789 | 4/1975 | United Kingdom . |
| 1506476 | 4/1978 | United Kingdom . |
| 2062075 | 5/1981 | United Kingdom . |

OTHER PUBLICATIONS

"Journal of American Ceramic Society", 50, pp. 101–105 (1967).

*Primary Examiner*—Veronica O'Keefe
*Attorney, Agent, or Firm*—Birch, Stewart, Kolasch & Birch

[57] ABSTRACT

A fiber-reinforced metal composite material comprising a metal or alloy as the matrix and an inorganic fiber as the reinforcing material, characterized in that at least one element selected from the group consisting of elements belonging to the fourth or higher periods of the group (IA) in the periodic table, elements belonging to the fifth or higher periods of the group (IIA) in the periodic table, and Bi and In in the form of simple substance or organic or inorganic compound is incorporated into either one or both of the matrix metal or the reinforcing material in an amount of 0.0005 to 10% by weight (calculated in terms of the element) so as to enhance the mechanical strength of the composite material.

12 Claims, No Drawings

METHOD FOR PREPARING FIBER-REINFORCED METAL COMPOSITE MATERIAL

This application is a divisional of application Ser. No. 285,975, filed on July 23, 1981, now U.S. Pat. No. 4,489,138.

The present invention relates to fiber-reinforced metal composite materials (hereinafter referred to as "composite materials") having an excellent mechanical strength and comprised of an inorganic fiber as the reinforcing material and a metal or alloy as the matrix (hereinafter referred to as "matrix metal").

Recently, novel composite materials comprising an inorganic fiber (e.g. an alumina fiber, a carbon fiber, a silica fiber, a silicon carbide fiber, a boron fiber) as the reinforcing material and a metal (e.g. aluminum, magnesium, copper, nickel, titanium) as the matrix have been developed and begun to be used in many industrial fields.

In combining an inorganic fiber with a metal, a reaction is caused at the interface between the matrix metal which is melted or maintained at a high temperature and the inorganic fiber to create a weakened layer so that the strength of the resultant composite material is, in many cases, lower than the theoretical value. For example, commercially available carbon fibers usually possess a strength of about 300 kg/mm$^2$, and the theoretical strength of a carbon fiber-reinforced composite material is calculated to be about 150 kg/mm$^2$ according to the rule of mixture, the content of fiber being assumed to be 50% by volume, even when the strength of the matrix material is neglected. In fact, a carbon fiber-reinforced epoxy resin composite material shows a strength of 150 kg/mm$^2$ or larger, while the strength of a carbon fiber-reinforced metal composite material obtained by the liquid metal-infiltration method using aluminum as the matrix is only about 30–40 kg/mm$^2$ at a maximum. This is due to deterioration of the fiber caused by an interfacial reaction between the fiber and the melted metal as mentioned above.

For prevention of the above deterioration of fibers, various methods are adopted, including treatment of the fiber surface with a coating agent. In Japanese Patent Publication (unexamined) No. 30407/1978, for example, there is disclosed a procedure in which the surface of silicon carbide fiber is protected with metals or ceramics forming a compound being inactive or stable to carbon and then the fiber is combined with a matrix metal. Though this method is effective for a silicon carbide fiber, a sufficient result is not obtained for other inorganic fibers, and there is a problem of troublesome handling. Japanese Patent Publication (unexamined) No. 70116/1976 describes that the mechanical strength of a fiber-reinforced metal composite material is increased by addition of lithium in an amount of several percents to an aluminum matrix. However, this method is effective only in cases where the inorganic fiber is not compatible or does not react with the matrix metal. In the case where the inorganic fiber reacts with the matrix metal and its deterioration is caused, a substantial effect is not obtained, but the mechanical strength tends to be rather lowered. Thus, a practically useful method for overcoming the above mentioned drawbacks is not yet established.

For the purpose of increasing the mechanical strength of a fiber-reinforced metal composite material, an extensive study has been made. As the result, it has been found that, by incorporation of at least one element selected from the group consisting of metals belonging to the fourth or higher periods of the group (IA) in the periodic table (K, Cs, Rb, Fr) and to the fifth or higher periods of the group (IIA) in the periodic table (Sr, Ba, Ra) and Bi and In into a matrix metal of a fiber-reinforced metal composite material, the deterioration of the inorganic fiber due to its reaction with the matrix metal can be prevented, and the mechanical strength of composite material comprising such a matrix metal can be greatly increased. The present invention is based on this finding.

As the inorganic fiber to be used as the reinforcing material in the invention, there may be exemplified a carbon fiber, a silica fiber, a silicon carbide fiber containing free carbon, a boron fiber, an alumina fiber, etc. Among them, the alumina fiber described in Japanese Patent Publication (examined) No. 13768/1976 can afford the most notable metal-reinforcing effect.

This alumina fiber is obtained by admixing a polyaluminoxane having structural units of the formula:

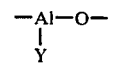

wherein Y is at least one of an organic residue, a halogen atom and a hydroxyl group with at least one compound containing silicon in such an amount that the silica content of the alumina fiber to be obtained becomes 28% or less, spinning the resultant mixture and subjecting the obtained precursor fiber to calcination. Particularly preferred is the alumina fiber which has a silica content of 2 to 25% by weight and which does not materially show the reflection of $\alpha$-$Al_2O_3$ in the X-ray structural analysis. The alumina fiber may contain one or more refractory such as oxides of lithium, beryllium, boron, sodium, magnesium, silicon, phosphorus, potassium, calcium, titanium, chromium, manganese, yttrium, zirconium, lanthanum, tungsten and barium in such an amount that the effect of the invention is not substantially reduced.

The content of the inorganic fiber in the composite material of the invention is not particularly limited. Preferably, it may be from 15 to 70% by volume. When it is less than 15% by volume, the reinforcing effect is insufficient. When the volume is more than 70%, the strength is rather decreased due to the contact between fiber elements. The shape of the fiber may be long or short, and depending on the purpose or the use, there may be employed either a long fiber a short fiber, or both in combination. For obtaining the desired mechanical strength or modulus of elasticity, a suitable orienting method such as unidirection ply, corss ply or random orientation ply may be selected.

As the matrix metal, aluminum, magnesium, copper, nickel, titanium, etc. may be employed. Their alloys are also usable. In the case that a light weight and a high mechanical strength are required, the system containing as the matrix aluminum, magnesium or their alloy is desirable. When a thermal resistance and a high strength are required, the system containing nickel or titanium as the matrix is favorable. These metals may contain a small amount of impurities insofar as they can be used in an ordinary way without trouble.

The characteristic feature of the present invention is that at least one element selected from the group consisting of metals belonging to the fourth and higher periods of the group (IA) in the periodic table (potassium, cesium, rubidium, francium) and to the fifth and higher periods of the group (IIA) in the periodic table (stronthium, barium, radium) and bismuth and indium is incorporated in the matrix metal or the inorganic fiber, whereby the mechanical strength of the resulting fiber-reinforced metal composite material is greatly increased. The mechanism for such increase of the strength is still unclear but may be assumed as follows.

When the said element is added to the matrix metal, the concentration of such element at the surface of the matrix metal becomes higher than the average concentration. In case of aluminum, for example, addition of bismuth, indium, stronthium or barium in an amount of 0.1 mol % decreases the surface tension of aluminum by 400, 20, 60 or 300 dyn/cm, respectively, in comparison with the surface tension of pure aluminum. This is attributable to the fact that the concentration of the element at the surface portion is higher than the average concentration in the matrix as shown by the Gibbs' adsorption isotherm. It is thus suggested that, in a fiber-reinforced metal composite material which comprises a matrix metal containing the said element, the element is accumulated in a high concentration at the fiber-matrix interface. This has been actually confirmed by the aid of Auger's scanning microscope and EPMA (Electron Probe Micro Analyser).

Observations with a scanning electron microscope of the broken surface of an inorganic fiber-reinforced metal composite material, prepared from a matrix metal containing the said element according to the liquid metal infiltration method, reveals that, the bonding strength of the fiber-matrix interface in the fiber-reinforced metal composite material comprising bismuth- and/or indium-containing aluminum as the matrix is weaker than that in the fiber-reinforced metal composite material not containing such element. Furthermore the reaction phase with the matrix metal having been observed at the extraperipheral surface of the fiber disappears, whereby it is understood that the reaction at the fiber-matrix interface is diminished. Namely, the said element is present in a high concentration at the fiber-matrix interface and controls the reaction at the interface so that the mechanical strength of the composite material is greatly increased.

In case of the fiber-reinforced metal composite material comprising a matrix metal containing one or more chosen from elements belonging to the fourth and higher periods of the group (IA) in the periodic table (K, Rb, Cs, Fr), elements belonging to the fifth and higher periods of the group (IIA) in the periodic table (Sr, Ba, Ra) and Bi and In, the combination at the fiber-matrix interface is not weakened in comparison with the system containing no additional metal, and nevertheless the reaction phase with the matrix metal having been observed at the extraperipheral surface of the fiber disappears. When the composite material is treated with an aqueous hydrochloric acid solution to remove the matrix metal and the recovered fiber is subjected to determination of the tensile strength, a considerable decrease of the tensile strength is observed in the system not containing the said element, compared with the tensile strength of the fiber before used. In the system containing the element, no material decrease of the tensile strength of the fiber is observed.

To the contrary, in case of the fiber-reinforced metal composite material comprising as the matrix an aluminum alloy containing 0.5% by weight of sodium or lithium of the group (IA) in the periodic table or 5% by weight of magnesium of the group (IIA) in the periodic table, the strength is greatly decreased, and the presence of the reaction phase at the extraperipheral surface of the fiber is confirmed in observations of the broken surface by the aid of a scanning electron microscope. The tensile strength of the fiber recovered after elimination of the matrix metal is greatly lowered in comparison with the tensile strength of the fiber previously used. Apparently, the element chosen from the fourth and higher periods of the group (IA), the fifth and higher periods of the group (IIA) and Bi and In react with the fiber at the interface, but due to their large atomic diameters, their diffusion into the fiber is difficult so that deterioration of the fiber is not caused and the bonding strength of the fiber-matrix at the interface is increased.

It is thus supposed that the said elements accumulate in high concentrations at the fiber-matrix interface and react with the fiber in a single layer to control the reaction between the fiber and the matrix metal, which results in great increase of the mechanical strength of the composite material.

The said element may be employed in the form of either simple substance or an inorganic or organic compound. It is surprising that the element incorporated in the form of a compound can afford similar effects as the one incorporated in the form of a simple substance. Supposedly, a part of or the whole portion of the inorganic or organic metal compound is decomposed or reduced before or after the combination of the fiber with the matrix metal and exerts a similar activity to that of the simple substance itself. The use of the element in the form of a compound is particularly advantageous when its simple substance is chemically unstable and can be handled only with great difficulty. As the inorganic and organic compounds of the element, there may be exemplified halides, hydrides, oxides, hydroxides, sulfonates, nitrates, carbonates, chlorates, carbides, nitrides, phosphates, sulfides, phosphides, alkyl compounds, organic acid compounds, alcoholates, etc.

The amount of the element in the form of a simple substance or of a compound to be incorporated may be usually from 0.0005 to 10% by weight (in terms of element) to the weight of the matrix metal. When the amount is less than 0.0005% by weight, the technical effect is insufficient. When the amount is larger than 10% by weight, the characteristic properties of the matrix metal are deteriorated to cause decrease of corrosion-resistance, reduction of elongation, etc.

The incorporation of the element into the matrix metal of the fiber-reinforced metal composite material may be effected by various procedures. For example, the simple substance or the organic or inorganic compound may be applied to the surface of the inorganic fiber to form a coating layer thereon, and the fiber is then combined with the matrix metal. The use of the organic or inorganic compound of the metal element is particularly advantageous when handling of the simple substance is troublesome. The formation of the coating layer on the surface of the inorganic fiber may be effected by various procedures such as electroplating, non-electrolytic plating, vacuum evaporation, spattering evaporation, chemical evaporation, plasma spraying, solution immersion and dispersion immersion.

Among these procedures, the solution immersion method and the dispersion immersion method are particularly preferable for formation of a coating layer of the inorganic or organic compound of the element on the surface of the fiber. In these methods, the compound of the element is dissolved or dispersed in a suitable solvent, and the inorganic fiber is immersed therein and then dried. The thus treated fiber is then combined with the matrix metal to obtain a fiber-reinforced metal composite material having a high strength. This is an extremely simple and economical procedure in comparison with other procedures for coating layer-formation.

The coating layer is desired to have a thickness of 20 Å or more. When the thickness is less than 20 Å, a sufficient effect is not obtained.

It is characterized in this invention that a good result can be obtained in the combination with the matrix metal even when the coating layer of the element in the form of a simple substance or a compound form made on the surface of the inorganic fiber has not a uniform thickness. This is probably explained by the reason that a part of the element applied on the fiber surface is dissolved in the matrix metal and is present in a high concentration at the fiber-matrix metal interface by the above mentioned mechanism.

The incorporation of the element into the matrix metal may be also effected by adding it in the form of either the simple substance or compound to the matrix metal. This method is advantageous in that the operation of coating of the fiber surface is unnecessary. The addition of the element into the matrix metal may be effected by a conventional procedure usually adopted for preparation of alloys. For example, the matrix metal is melted in a crucible in the air or in an inactive atmosphere, and after the element in the form of a simple substance or a compound form is added thereto, the mixture is stirred well and cooled. In some cases, powdery matrix metal may be admixed with powdery inorganic or organic compound of the element.

The preparation of the composite material of the invention may be effected by various procedures such as liquid phase methods (e.g. liquid-metal infiltration method), solid phase methods (e.g. diffusion bonding), powdery metallurgy (sintering, welding), precipitation methods (e.g. melt spraying, electrodeposition, evaporation), plastic processing methods (e.g. extrusion, compression rolling) and squeeze casting method. Among these procedures, particularly preferred are the liquid-metal immersion method and the high pressure coagulation casting method in which the melted metal is directly contacted with the fiber. A sufficient effect can be also obtained in other procedures mentioned above.

The thus prepared composite materials show a great increase in mechanical strength as compared with the system not containing the element of the invention. It is an extremely valuable merit of the invention that the preparation of this composite material can be realized in a conventional manner by the aid of usual equipments without any alteration.

The present invention will be hereinafter explained further in detail by the following Examples which are not intended to limit the scope of the invention.

EXAMPLE 1

In a crucible made of graphite, aluminum having a purity of 99.99% by weight was melted under heating up to 700° C. in an argon atmosphere. A designed amount of the element in the form of simple substance as shown in Table 1 was added thereto, and the contents were stirred well and cooled to obtain a matrix alloy.

As the inorganic fiber, the following substances were employed: (1) alumina fiber having an average fiber diameter of 14 μm, a tensile strength of 150 kg/mm$^2$ and a Young's modulus of elasticity of 23,500 kg/mm$^2$ ($Al_2O_3$ content, 85% by weight; $SiO_2$ content, 15% by weight); (2) carbon fiber having an average fiber diameter of 7.5 μm, a tensile strength of 300 kg/mm$^2$ and a Young's modulus of elasticity of 23,000 kg/mm$^2$; (3) free carbon-containing silicon carbide fiber having an average fiber diameter of 15 μm, a tensile strength of 220 kg/mm$^2$ and a Young's modulus of elasticity of 20,000 kg/mm$^2$; (4) silica fiber having an average fiber diameter of 9 μm, a tensile strength of 600 kg/mm$^2$ and a Young's modulus of elasticity of 7,400 kg/mm$^2$; and (5) boron fiber having an average fiber diameter of 140 μm, a tensile strength of 310 kg/mm$^2$ and a Young's modulus of elasticity of 38,000 kg/mm$^2$. The inorganic fiber was introduced in parallel into a casting tube having an inner diameter of 4 mmϕ. Then, the above obtained alloy was melted at 700° C. in an argon atmosphere, and one end of the casting tube was immersed therein. While the other end of the tube was degassed in vacuum, a pressure of 50 kg/cm$^2$ was applied onto the surface of the melted alloy, whereby the melted alloy was infiltrated into the fiber. This composite material was cooled to complete the combination. The fiber content of the composite material was regulated to become 50±1% by volume.

For comparison, a fiber-reinforced metal complex material comprising pure aluminum (purity, 99.99% by weight) as the matrix was prepared by the same procedure as above. The thus obtained fiber-reinforced metal composite materials were subjected to determination of flexural strength and flexural modulus. The results are shown in Table 1. In all of the composite materials comprising the alloy matrix, the mechanical strength was greatly increased in comparison with the composite materials comprising the pure aluminum matrix.

TABLE 1

| Run No. | Inorganic fiber | Element added Kind | Element added Amount (% by wt.) | Flexural strength (kg/mm$^2$) | Flexural modulus (kg/mm$^2$) |
|---|---|---|---|---|---|
| Example | | | | | |
| 1 | Alumina fiber | Potassium | 0.05 | 78.6 | 12800 |
| 2 | Alumina fiber | Rubidium | 0.05 | 108 | 12900 |
| 3 | Alumina fiber | Cesium | 0.005 | 89.2 | 12800 |
| 4 | Alumina fiber | Cesium | 0.05 | 110 | 12900 |
| 5 | Alumina fiber | Cesium | 0.10 | 115 | 12400 |
| 6 | Alumina fiber | Strontium | 0.008 | 78.1 | 12700 |
| 7 | Alumina fiber | Strontium | 1.0 | 122 | 13200 |
| 8 | Alumina fiber | strontium | 4.0 | 77.8 | 13800 |
| 9 | Alumina fiber | Barium | 0.004 | 98.8 | 13400 |
| 10 | Alumina fiber | Barium | 1.0 | 149 | 13400 |

TABLE 1-continued

| Run No. | Inorganic fiber | Element added Kind | Element added Amount (% by wt.) | Flexural strength (kg/mm²) | Flexural modulus (kg/mm²) |
|---|---|---|---|---|---|
| 11 | Alumina fiber | Barium | 4.0 | 118 | 12800 |
| 12 | Alumina fiber | Bismuth | 0.005 | 92.2 | 12100 |
| 13 | Alumina fiber | Bismuth | 0.5 | 130 | 12200 |
| 14 | Alumina fiber | Indium | 0.01 | 80.6 | 13100 |
| 15 | Alumina fiber | Indium | 1.0 | 88.0 | 12900 |
| 16 | Carbon fiber | Cesium | 0.05 | 64.4 | 12900 |
| 17 | Carbon fiber | Barium | 0.004 | 56.4 | 13800 |
| 18 | Carbon fiber | Barium | 1.5 | 65.8 | 12900 |
| 19 | Carbon fiber | Bismuth | 0.5 | 62.3 | 12800 |
| 20 | Silicon carbide fiber | Cesium | 0.05 | 64.4 | 12900 |
| 21 | Silicon carbide fiber | Barium | 0.004 | 63.2 | 11900 |
| 22 | Silicon carbide fiber | Barium | 0.3 | 88.4 | 12000 |
| 23 | Silica fiber | Bismuth | 0.5 | 42.5 | 750 |
| 24 | Boron fiber | Bismuth | 1.0 | 76.1 | 20300 |
| Comparative Example | | | | | |
| 25 | Alumina fiber | — | — | 70.0 | 12600 |
| 26 | Carbon fiber | — | — | 43.0 | 13000 |
| 27 | Silicon carbide fiber | — | — | 32.5 | 12100 |
| 28 | Silica fiber | — | — | 31.1 | 7300 |
| 29 | Boron fiber | — | — | 35.1 | 18200 |

EXAMPLE 2

In a crucible made of graphite, aluminum having a purity of 99.99% by weight was melted under heating up to 700° C. in an argon atmosphere. A designed amount of the element in the form of compound as shown in Table 2 was added thereto, and the mixture was stirred well and then cooled to obtain a matrix alloy.

As the inorganic fibers, the same alumina fiber, carbon fiber and silicon carbide fiber as used in Example 1 were employed, and the same procedure as in Example 1 was used to obtain fiber-reinforced metal composite materials. The fiber content of the composite material was regulated to become 50±1% by volume.

The thus prepared fiber-reinforced metal composite materials were subjected to determination of flexural strength at room temperature. The results are shown in Table 2. All of the composite materials produced the marked increase of the mechanical strength in comparison with Comparative Example as shown in Table 1.

TABLE 2

| Run No. | Inorganic fiber | Element added Kind | Element added Amount (% by wt.) | Flexural strength (kg/mm²) |
|---|---|---|---|---|
| Example | | | | |
| 30 | Alumina fiber | Cesium chloride | 0.05 | 108 |
| 31 | Alumina fiber | Barium chloride | 0.5 | 97.1 |
| 32 | Alumina fiber | Barium hydroxide | 0.5 | 90.3 |
| 33 | Alumina fiber | Bismuth chloride | 1.0 | 85.5 |
| 34 | Alumina fiber | Cesium sulfate | 0.1 | 98.6 |
| 35 | Alumina fiber | Cesium nitrate | 0.1 | 96.9 |
| 36 | Alumina fiber | Rubidium carbonate | 0.1 | 87.1 |
| 37 | Alumina fiber | Strontium acetate | 0.5 | 85.7 |
| 38 | Alumina fiber | Cesium ethyl oxide | 0.1 | 80.3 |
| 39 | Alumina fiber | Barium methyl-sulfate | 0.5 | 81.2 |
| 40 | Carbon fiber | Barium chloride | 0.5 | 64.2 |
| 41 | Silicon carbide fiber | Barium chloride | 0.5 | 73.9 |

EXAMPLE 3

In this example, magnesium, copper or nickel is employed as the matrix metal.

In case of magnesium, commercially available pure magnesium (purity, 99.9% by weight) was melted under heating up to 700° C. in an argon atmosphere in a crucible made of graphite. A designed amount of the element in the form of simple substance as shown in Table 3 was added thereto, and the mixture was stirred well and cooled to obtain a matrix alloy, which was then combined with the same alumina fiber as used in Example 1 by the same procedure as in Example 1 to obtain a fiber-reinforced metal composite material. For comparison, a composite material comprising pure magnesium as the matrix was prepared by the same procedure as above. The fiber content of the composite material was regulated to become 50±1% by volume.

In case of copper, the same alumina fiber as in Example 1 was immersed into a dispersion obtained by dispersing copper powder (300 mesh pass) (98.0 g) and bismuth power (300 mesh pass) (2.0 g) in a solution of polymethyl methacrylate in chloroform to prepare an alumina fiber sheet whose surface was coated with powdery copper and bismuth. The sheet had a thickness of about 250μ and a fiber content of 56.7% by volume. Ten of the sheets were piled and charged into a carbon-made casting tool, which was placed into a vacuum hot press and heated at 450° C. with a vacuum degree of $10^{-2}$ Torr to decompose polymethyl methacrylate as the sizing agent. The pressure and the temperature were gradually elevated, and the final condition of $10^{-3}$ Torr, 650° C. and 400 kg/mm² was kept for 20 minutes to obtain a fiber-reinforced metal composite material. For comparison, a fiber-reinforced metal composite material comprising copper alone as the matrix was prepared by the same procedure as above.

In case of nickel, the same alumina fiber as used in Example 1 was immersed into a dispersion obtained by dispersing Ni-2.0% by weight Ba alloy powder in a solution of polymethyl methacrylate in chloroform to prepare an alumina fiber sheet whose surface was coated with Ni-2.0% by weight Ba alloy powder. This sheet had a thickness of about 250μ and a fiber content of 55.4% by volume. Ten of the sheets were piled and charged into a carbon-made casting tool, which was placed into a vacuum hot press and heated at 450° C. for 2 hours with a vacuum degree of $10^{-2}$ Torr to decompose polymethyl methacrylate as the sizing agent. The pressure and the temperature were then gradually elevated, and the final condition of $10^{-3}$ Torr, 900° C. and 400 kg/mm$^2$ was kept for 30 minutes to obtain a fiber-reinforced metal composite material. For comparison, a fiber-reinforced metal composite material comprising Ni alone as the matrix was prepared by the same procedure as above.

These complex materials were subjected to determination of flexural strength at room temperature. The results are shown in Table 3. All of the complex materials produced the great increase of the strength in comparison with Comparative Example as shown therein.

TABLE 3

| | Run No. | Matrix metal | Flexural strength (kg/mm$^2$) |
|---|---|---|---|
| Example | 42 | Mg-0.08% Cs | 63.5 |
| | 43 | Mg-2.4% Ba | 72.4 |
| | 44 | Mg-2.4% Bi | 68.5 |
| | 45 | Cu-2.0% Bi | 70.3 |
| | 46 | Ni-2.0% Ba | 76.4 |
| Comparative Example | 47 | Mg | 40.3 |
| | 48 | Cu | 47.8 |
| | 49 | Ni | 53.8 |

EXAMPLE 4

As the inorganic fiber, alumina fiber, carbon fiber, silica fiber, silicon carbide fiber and boron fiber were employed. On the surface of each of these fibers, a coating layer of bismuth, indium, barium, strontium, radium, potassium, cesium or rubidium having a thickness of about 50 Å was formed by the vacuum evaporation method according to the fiber-metal combination shown in Table 4. The thus obtained metal-coated inorganic fiber was cut into 110 mm length in an argon atmosphere, and these pieces were bundled and introduced in parallel into a casting tube having an inner diameter of 4 mm. Into melted aluminum (purity, 99.99% by weight) kept at 700° C. in an argon atmosphere, one end of the casting tube was immersed, and while the other end was degassed in vacuum, a pressure of 50 kg/cm$^2$ was applied onto the surface of the melted aluminum, whereby the melted aluminum was infiltrated into the fiber. Then, the product was cooled to obtain a fiber-reinforced metal composite material. The fiber content was regulated to become 50±1% by volume.

The thus obtained fiber-reinforced metal composite material was subjected to determination of flexural strength and flexural modulus. The results are shown in Table 4. All of the cases using carbon fiber, aluminum fiber, silica fiber, silicon carbide fiber or boron fiber as the reinforcing material produced the great increase of the strength in comparison with Comparative Example as shown in Table 1.

TABLE 4

| Run No. | Fiber | Coating element | Flexural strength (kg/mm$^2$) | Flexural modulus (kg/mm$^2$) |
|---|---|---|---|---|
| Example | | | | |
| 50 | Alumina fiber | Indium | 87.0 | 12900 |
| 51 | Alumina fiber | Barium | 130 | 13000 |
| 52 | Alumina fiber | Strontium | 95.4 | 12800 |

TABLE 4-continued

| Run No. | Fiber | Coating element | Flexural strength (kg/mm$^2$) | Flexural modulus (kg/mm$^2$) |
|---|---|---|---|---|
| 53 | Alumina fiber | Potassium | 80.2 | 13200 |
| 54 | Alumina fiber | Cesium | 98.1 | 13000 |
| 55 | Alumina fiber | Rubidium | 96.9 | 13000 |
| 56 | Carbon fiber | Bismuth | 60.5 | 12900 |
| 57 | Carbon fiber | Barium | 62.3 | 13300 |
| 58 | Carbon fiber | Cesium | 58.6 | 13200 |
| 59 | Silica fiber | Bismuth | 41.4 | 9400 |
| 60 | Silica fiber | Strontium | 42.8 | 9100 |
| 61 | Silica fiber | Rubidium | 43.6 | 8800 |
| 62 | Silicon carbide fiber | Bismuth | 63.8 | 11900 |
| 63 | Silicon carbide fiber | Barium | 66.2 | 12300 |
| 64 | Silicon carbide fiber | strontium | 59.7 | 12200 |
| 65 | Silicon carbide fiber | Cesium | 64.3 | 12300 |
| 66 | Boron fiber | Bismuth | 75.9 | 19800 |
| 67 | Boron fiber | Strontium | 68.2 | 19600 |
| 68 | Boron fiber | Rubidium | 70.1 | 20100 |

EXAMPLE 5

As the inorganic fiber, the same alumina fiber, carbon fiber, silica fiber, silicon carbide fiber and boron fiber as in Example 1 were employed. Into a 2% by weight aqueous solution of barium chloride, cesium chloride or bismuth nitrate, the inorganic fiber was immersed according to the combination of inorganic fiber and metal as shown in Table 1 and then dried in a hot air drier at 130° C. for 3 hours. By observation of the fiber surface with a scanning electron microscope, it was confirmed that a coating layer having a thickness of 0.05–1.0 μm, though not uniform, was formed thereon. The thus treated inorganic fiber was cut into 110 mm long, and these pieces were bundled and introduced in parallel into a casting tube having an inner diameter of 4 mm. Into melted aluminum (purity, 99.99% by weight) kept at 700° C. in an argon atmosphere, one end of the casting tube was immersed, and while the other end was degassed in vacuum, a pressure of 50 kg/cm$^2$ was applied onto the surface of the melted aluminum, whereby the melted aluminum was infiltrated into the fiber. Then, the product was cooled to obtain a fiber-reinforced metal composite material. The fiber content was regulated to become 50±1% by volume.

The thus obtained fiber-reinforced metal composite material was subjected to determination of flexural strength and flexural modulus. The results are shown in Table 5. All of the cases using carbon fiber, aluminum fiber, silica fiber, silicon carbide fiber or boron fiber as the reinforcing material produced the great increase of the mechanical strength in comparison with Comparative Example as shown in Table 1.

TABLE 5

| Run No. | Fiber | Metal compound used in surface treatment | Flexural strength (kg/mm$^2$) | Flexural modulus (kg/mm$^2$) |
|---|---|---|---|---|
| Example | | | | |
| 69 | Carbon fiber | Barium chloride | 57.2 | 13000 |
| 70 | Carbon fiber | Bismuth nitrate | 59.4 | 12800 |
| 71 | Alumina fiber | Barium chloride | 105 | 12800 |

TABLE 5-continued

| Run No. | Fiber | Metal compound used in surface treatment | Flexural strength (kg/mm²) | Flexural modulus (kg/mm²) |
|---|---|---|---|---|
| 72 | Alumina fiber | Cesium chloride | 110 | 12900 |
| 73 | Alumina fiber | Bismuth nitrate | 107 | 12500 |
| 74 | Silica fiber | Bismuth nitrate | 46.5 | 9200 |
| 75 | Silicon carbide fiber | Barium chloride | 67.1 | 12500 |
| 76 | Silicon carbide fiber | Cesium chloride | 73.4 | 12600 |
| 77 | Boron fiber | Bismuth nitrate | 70.8 | 18500 |
| 78 | Boron fiber | Barium chloride | 75.4 | 18200 |

EXAMPLE 6

On the surface of the same alumina fiber as used in Example 1, a coating layer of bismuth having a thickness of about 1000 Å was formed by the plasma spray method. Using the thus treated alumina fiber and magnesium (purity, 99.99% by weight) melted at about 700° C. in an argon atmosphere, a fiber-reinforced metal composite material was prepared in the same manner as in Example 1. Then, another fiber-reinforced metal composite material was prepared from the same alumina fiber as above and copper (purity, 99.99% by weight) melted at 1100° C. in an argon atmosphere in the same manner as in Example 1. These composite materials were subjected to determination of flexural strength. The results are shown in Table 6. In both cases, a higher flexural strength was obtained in comparison with Comparative Example as shown in Table 3.

TABLE 6

| | Run No. | Matrix metal | Coating metal | Flexural strength (kg/mm²) |
|---|---|---|---|---|
| Example | 79 | Magnesium | Bismuth | 62.8 |
| | 80 | Copper | Barium | 63.5 |

EXAMPLE 7

The same alumina fiber as in Example 1 was immersed into a 2% aqueous solution of barium chloride and then dried. The alumina fiber was subjected to reduction at 700° C. in the stream of hydrogen to precipitate out barium metal on the surface of the alumina fiber. Then, combination of the thus treated alumina fiber with aluminum was effected in the same manner as in Example 1 to obtain a fiber-reinforced metal composite material. The flexural strength of this composite material at room temperature was 124 kg/mm². Thus, the great increase of the flexural strength was attained in comparison with Comparative Example in Table 1.

What is claimed is:

1. A method for preparing a fiber-reinforced metal composite material consisting essentially of:

adding at least one element selected from the group consisting of K, Cs, Rb, Fr, Sr, Ba, Ra and In in an amount of 0.0005 to 10% by weight into molten metal or molten alloy; and combining the thus prepared matrix containing at least one of said elements with an inorganic fiber reinforcing material to form the fiber-reinforced metal composite material.

2. The method according to claim 1, wherein said element is said matrix into said matrix in elemental form.

3. The method according to claim 1, wherein said element is said matrix into said matrix in the form of an inorganic or organic compound.

4. The method according to claim 1, wherein the inorganic fiber is a member selected from the group consisting of a carbon fiber, a silicon fiber, a silicon carbide fiber, a boron fiber or an alumina fiber.

5. The method according to claim 1, wherein the metal or alloy is a member selected from the group consisting of aluminum, magnesium, copper, nickel, titanium or alloys thereof.

6. A method for preparing a fiber-reinforced metal composite material consisting essentially of:

coating the surface of an inorganic fiber with at least one element selected from the group consisting of K, Cs, Rb, Fr, Sr, Ba, Ra and In in an amount of 0.0005 to 10% by weight; and combining the thus treated inorganic fiber with a molten metal or alloy matrix to form the fiber-reinforced metal composite material.

7. The method according to claim 6, wherein said element is in the form of an organic or inorganic compound to the surface of said inorganic fiber.

8. The method according to claim 6, wherein said element is coated on the surface of said inorganic fiber to form a layer which has a thickness of not less than 20 Å.

9. The method according to claim 6, wherein said inorganic fiber is a member selected from the group consisting of a carbon fiber, a silica fiber, a silicon carbide fiber, a boron fiber or an alumina fiber.

10. The method according to claim 6, wherein said element is in the elemental form.

11. The method according to claim 3, wherein said element is in the form of a member selected from the group consisting of halides, hydrides, oxides, hydroxides, sulfonates, nitrates, carbonates, chlorates, carbides, nitrides, phosphates, sulfides, phosphides, alkyl compounds and alcoholates.

12. The method according to claim 7, wherein said element is in the form of a member selected from the group consisting of halides, hydrides, oxides, hydroxides, sulfonates, nitrates, carbonates, chlorates, carbides, nitrides, phosphates, sulfides, phosphides, alkyl compounds and alcoholates.

* * * * *